US005498038A

United States Patent [19]

Simon et al.

[11] Patent Number: 5,498,038

[45] Date of Patent: Mar. 12, 1996

[54] MULTI-POINT DOOR LOCK SYSTEM

[75] Inventors: Ira J. Simon, Long Beach; George W. Curtis, Rowland Heights; Andrew B. Campbell, San Marino, all of Calif.

[73] Assignee: Marvin Lumber and Cedar Co., Warroad, Minn.

[21] Appl. No.: 19,160

[22] Filed: Feb. 16, 1993

[51] Int. Cl.[6] ..... E05C 1/12

[52] U.S. Cl. ..... 292/36; 292/333; 292/DIG. 21; 70/108; 70/150

[58] Field of Search ..... 292/36, 40, 332, 292/333, DIG. 21, 150, 109; 70/108, 110, 113, 107, 150

[56] References Cited

U.S. PATENT DOCUMENTS

| | | | |
|---|---|---|---|
| 279,334 | 6/1883 | Clark . | |
| 333,093 | 12/1885 | Wright . | |
| 958,880 | 5/1910 | Lawson | 292/36 |
| 966,208 | 8/1910 | Hoes . | |
| 998,642 | 7/1911 | Shean | 292/36 |
| 1,075,914 | 10/1913 | Hoes . | |
| 1,142,463 | 6/1915 | Shepherd | 292/DIG. 21 |
| 1,368,141 | 2/1921 | Hagstrom . | |
| 1,596,992 | 8/1926 | Ognowicz . | |
| 1,646,674 | 10/1927 | Angelillo | 70/110 |
| 1,850,222 | 3/1932 | Carlson | 292/36 |
| 3,129,579 | 4/1964 | Bellantuono | 70/150 |
| 3,242,706 | 3/1966 | Check | 70/110 |
| 4,049,306 | 9/1977 | Imhoff | 292/333 |
| 4,154,070 | 5/1979 | Bahry et al. | 70/120 |
| 4,726,613 | 2/1988 | Foshee | 292/150 |
| 4,950,005 | 8/1990 | Cudd | 292/150 |
| 5,004,277 | 4/1991 | Campbell et al. | 292/166 |
| 5,058,938 | 10/1991 | Döring et al. | 292/45 |
| 5,076,620 | 12/1991 | Campbell et al. | 292/138 |
| 5,339,659 | 8/1994 | Guzzinati | 70/120 |

FOREIGN PATENT DOCUMENTS

| | | | |
|---|---|---|---|
| 698213 | 11/1964 | Canada | 292/36 |
| 1062143 | 7/1959 | Germany . | |

*Primary Examiner*—Darnell M. Boucher
*Attorney, Agent, or Firm*—Nawrocki, Rooney & Sivertson

[57] ABSTRACT

A multi-point door lock system comprising an active lock and an inactive lock for use on single or double doors is self-teaching, provides one hand control of shoot bolts, and provides audible and tactile feedback associated with shoot bolt extension and retraction.

2 Claims, 5 Drawing Sheets

MULTI-POINT DOOR LOCK SYSTEM

BACKGROUND OF THE INVENTION

1. Field of the Invention

The field of the present invention relates to latches, locks and bolts used to secure doors. More particularly it relates to a door lock system which allows a door to be secured at its top, its bottom and its free (or non-hinged) edge.

2. Description of the Related Art

Door latches or locks which secure a door at its top, bottom and free edge are commonly referred to as three point or multi-point door latches or locks. Door configurations which may make use of a multi-point door lock include single doors and double doors where an "active" and an "inactive" double door meet along their respective free edges. As used herein, the "active" door of a double door is the one whose bolts and latches along the free edge (non-hinged edge) extend outward. The "inactive" door of a double door has receptacles along its free edge for receiving the bolts and latches extended from the active door. An "active door" includes an active door lock mechanism. An "inactive door" includes an inactive door lock mechanism.

The active door is the door of a pair which is utilized when only one door is required. The active door always unlatches first and latches last. In a single door installation, a single multi-point active lock mechanism is used to lock the door to the door frame. In a double door installation, a multi-point active lock mechanism is used on the active door and a multi-point inactive lock mechanism is used on the inactive door.

The door is secured at its top and bottom to the door frame with shoot bolts which are bolts attached to rods which attach to the multi-point door lock. The shoot bolts preferably run inside the door from the multi-point door lock and exit the door at its top edge and bottom edge.

A door or pair of doors secured with a multi-point door lock rather than a single point door lock generally has better resistance to high winds, air and moisture penetration, vandals, and other forces which might overcome a door latch by sheer force.

SUMMARY OF THE INVENTION

The present invention is directed to a multi-point door lock system for use in securing a single or a double door at its top, bottom and free edge(s). The present invention utilizes a similar mechanism with many common parts for the active and inactive versions of the lock.

In accordance with one aspect of the invention, a pin rotor, rotatably mounted to the case, is coupled to a shoot bolt rotor, also rotatably mounted to the case, with a linkage. This arrangement permits a relatively small, approximately 45° twist of the pin rotor to cause full extension or retraction of the upper and lower shoot bolts. This arrangement also permits the multi-point door lock components to be made physically small so that they can be contained in a case having a form factor sized 3 inches wide×6 inches high×0.75 inches thick.

In accordance with another aspect of the invention, operation of the various components of the multi-point door lock is physically controlled by the lock itself in the following manner: the active door or panel must be closed before the shoot bolt rotor can turn so as to extend the shoot bolts (i.e., the trigger on the free edge of the active lock must be in the retracted trigger position) and the shoot bolt rotor must be turned to extend the shoot bolts fully before the jamb bolt may be extended. This aspect of the invention compels the user to operate the features of the lock in the proper sequence so as to result in a maximally secured door. Thus, the lock is "self-teaching" in that one unfamiliar with the operation of the lock can quickly determine the sequence in which the lock operates because it operates in only one sequence.

In accordance with another aspect of the invention, audible and tactile feedback is provided in conjunction with the extension and retraction of the shoot bolts and in conjunction with the extension and retraction of the jamb bolt to provide the user with confidence that they are positioned correctly.

In accordance with another aspect of the invention, assembly of the shoot bolts and door locks within the door is facilitated by incorporating threaded and bevelled attachments to portions of the door latch which are adapted to mate like nut and bolt to portions of the shoot bolts.

Accordingly, it is an object of the present invention to provide an improved and novel multi-point door latch system. Other and further objects and advantages will appear hereinafter.

DESCRIPTION OF THE PREFERRED EMBODIMENTS

Introduction

The present invention relates to multi-point door locks used on a single or double door. A single door is always an "active" door. It has a vertical hinged edge and, on the opposite side, a vertical free edge. A common double door where the double doors meet along their common free edges consists of an "active" door which has an extendable bolt and an "inactive" door which has a receptacle for the bolt of the active door. In this way by extending the bolt of the active door into the receptacle of the inactive door the two doors are secured to one another. In the case of a pair of doors (double door) the shoot bolts must be extended into the door frame to secure the inactive door to the frame. A single door's bolt may be extended into the door jamb or door frame in order to secure it. In addition, multi-point door locks provide for bolts to be extended upward and downward to secure both the active and inactive door to the door frame at the top and bottom of the door for additional strength and resistance to opening force.

The Active Lock

Figure 1:
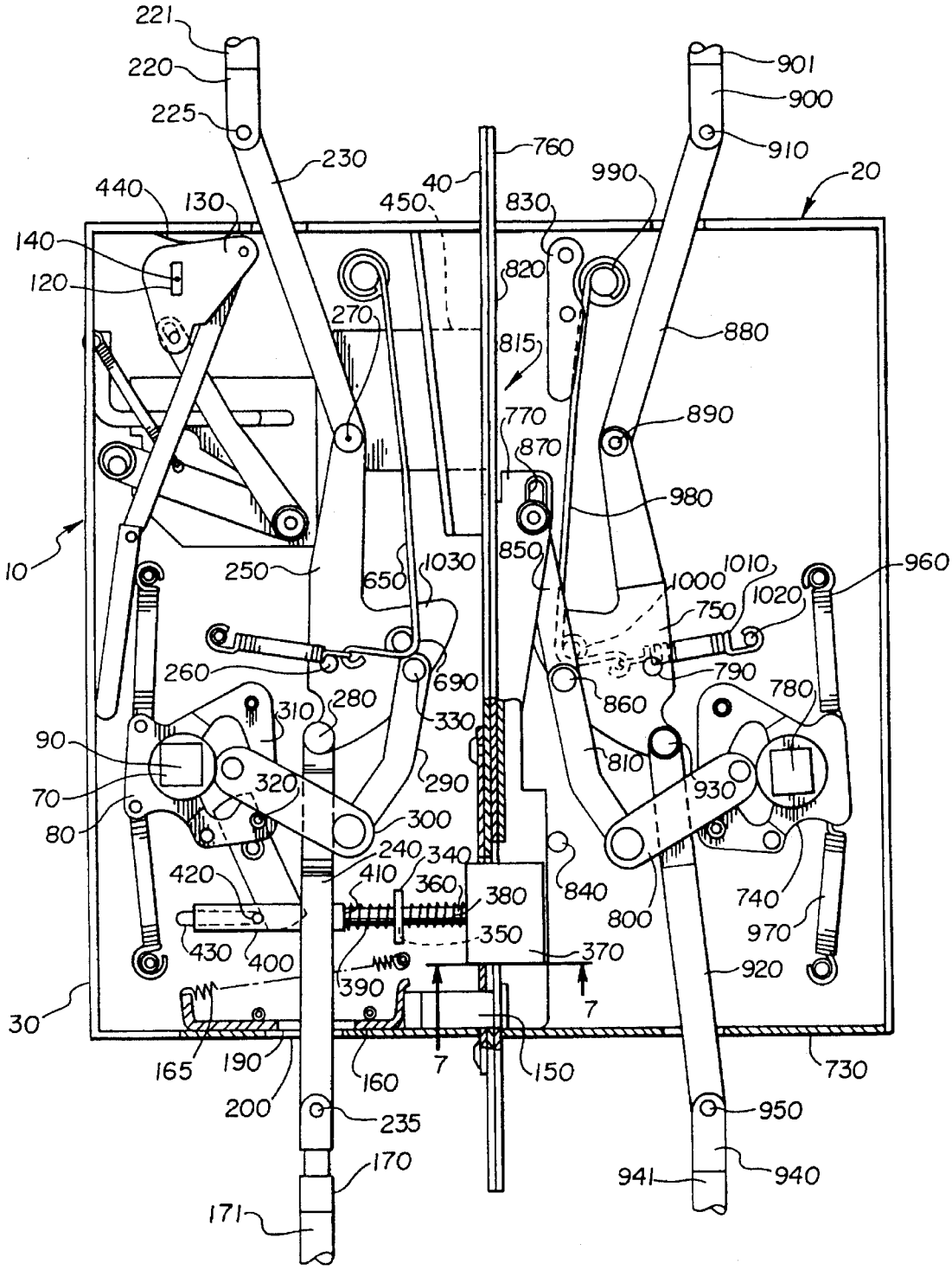
FIG. 1 is a front elevational drawing of (on the left) an active multi-point door lock and (on the right) an inactive multi-point door lock with the jamb bolt disengaged and the shoot bolts engaged.

Turning now to FIG. 1 an active multi-point door lock 10 is shown at the left next to an inactive multi-point door lock 20 at the right. This is typically how they would be installed in a double door configuration. Active multi-point door lock 10 includes a metal case 30 of dimensions 3 inches wide by 6 inches high by ¾ inches thick and a mounting flange 40 as a part of case or frame member 30. Active multi-point door lock 10 is designed to be mounted in either a single door or in the active one of a pair of double doors. Active multi-point door lock 10 is controlled by a door handle 50 in FIG. 8 which is attached to spindle 60 which fits into square hole 70 of pin rotor 80. Pin rotor 80 is rotatably mounted to case 30 at axis 90.

Figure 6:
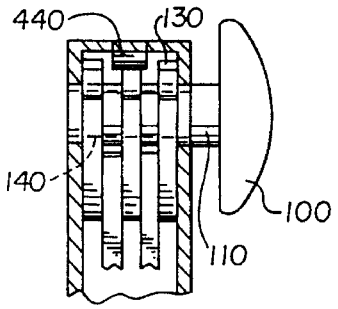
FIG. 6 is a side elevation view taken along line 6—6 of FIG. 2.

Active multi-point door lock 10 is also controlled by a lock knob 100 (FIG. 6) which is attached to lock spindle 110 which fits into rectangular hole 120 of key rotor 130. Key rotor 130 is rotatably mounted to case 30 at axis 140.

In most applications there will be a lock cylinder opposite lock knob 100 for rotating key rotor 130 with the correct key. Typically lock knob 100 would be mounted "inside" and the lock cylinder would be mounted "outside" as in a typical door installation as is well known in the art.

Figure 2:
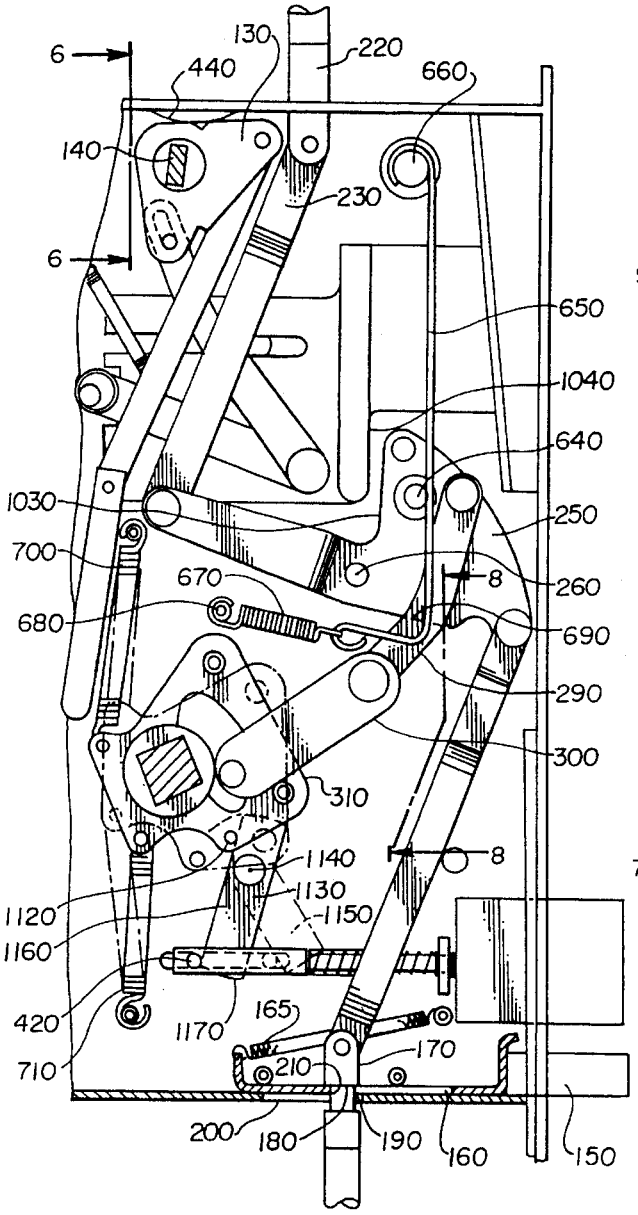
FIG. 2 is a front elevation drawing of an active multipoint door lock with jamb bolt, door latch, trigger and shoot bolts disengaged. Pin rotor movement controlling the passage latch is shown in phantom.

Trigger 150 senses when the active door is closed, either against a door jamb, or an inactive door. When the door is closed, trigger 150 is forced to retract into case 30 to its retracted trigger position as shown at the left side of FIG. 1. Trigger 150 is in contact with slide 160 which is biased with spring 165 to push trigger 150 toward its extended trigger position as shown in FIG. 2. When trigger 150 is in its extended trigger position (FIG. 2), slide 160 interferes with lower shoot bolt receptacle 170 to prevent its extension. When trigger 150 is in its retracted trigger position (FIG. 1), slide 160 no longer interferes with lower shoot bolt receptacle 170 and the shoot bolts (upper 221 and lower 171) may thus be extended. In more detail, lower shoot bolt receptacle 170 includes a lip 180. Slide 160 includes a hole 190. Case 30 includes a hole 200. Lower shoot bolt receptacle 170 is threaded through holes 190 and 200. When trigger 150 is in its extended trigger position, a portion 210 of slide 160 surrounding hole 190 blocks lower shoot bolt receptacle 170 at lip 180 from downward movement.

Upper shoot bolt receptacle 220 is pivotally connected to upper shoot bolt activation link 230 at pivot point 225. Likewise, lower shoot bolt receptacle 170 is pivotally connected to lower shoot bolt activation link 240 at pivot point 235.

Upper shoot bolt receptacle 220 and lower shoot bolt receptacle 170 are essentially identical and comprise threaded, bevelled portions 1180 (FIG. 10) into which shoot bolts 221 and 171 are bolted as nut to bolt. Thus, by inserting shoot bolts 221, 171 into their channel in the door and pushing them into contact with shoot bolt receptacles 220, 170, attachment is achieved by simply twisting shoot bolts 221, 171 until they tighten respectively into shoot bolt receptacles 220, 170. This feature significantly eases the installation process.

Figure 10:
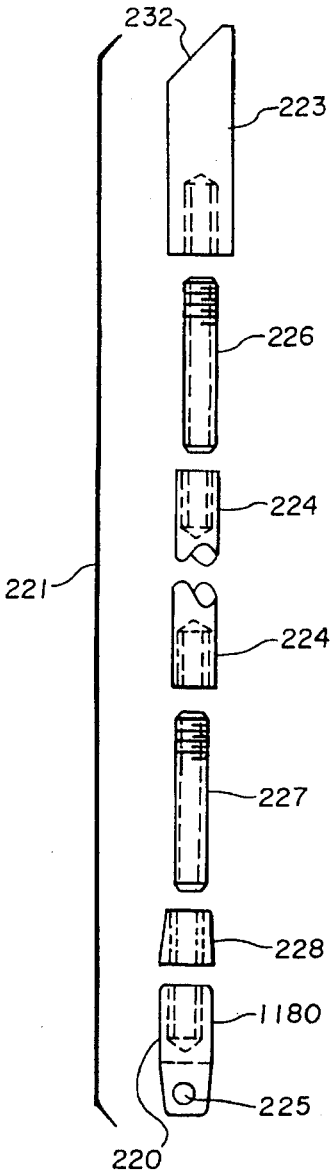
FIG. 10 is an exploded view of the components which make up the shoot bolts.

In a preferred embodiment of the present invention, shoot bolts 221 and 171 are fabricated as shown in FIG. 10 and comprise a bolt 223, a shoot bolt rod 224, threaded transition piece or stud 226 connecting shoot bolt rod 224 and bolt 223, threaded transition piece or stud 227 connected to shoot bolt rod 224 and onto which transition element 228 which has female threads on its interior is threaded. Threaded transition piece 227 screws into shoot bolt receptacle 220 to provide a smooth transition from receptacle 220 to rod 224. Stud 227 is not exposed after assembly.

Figure 11:
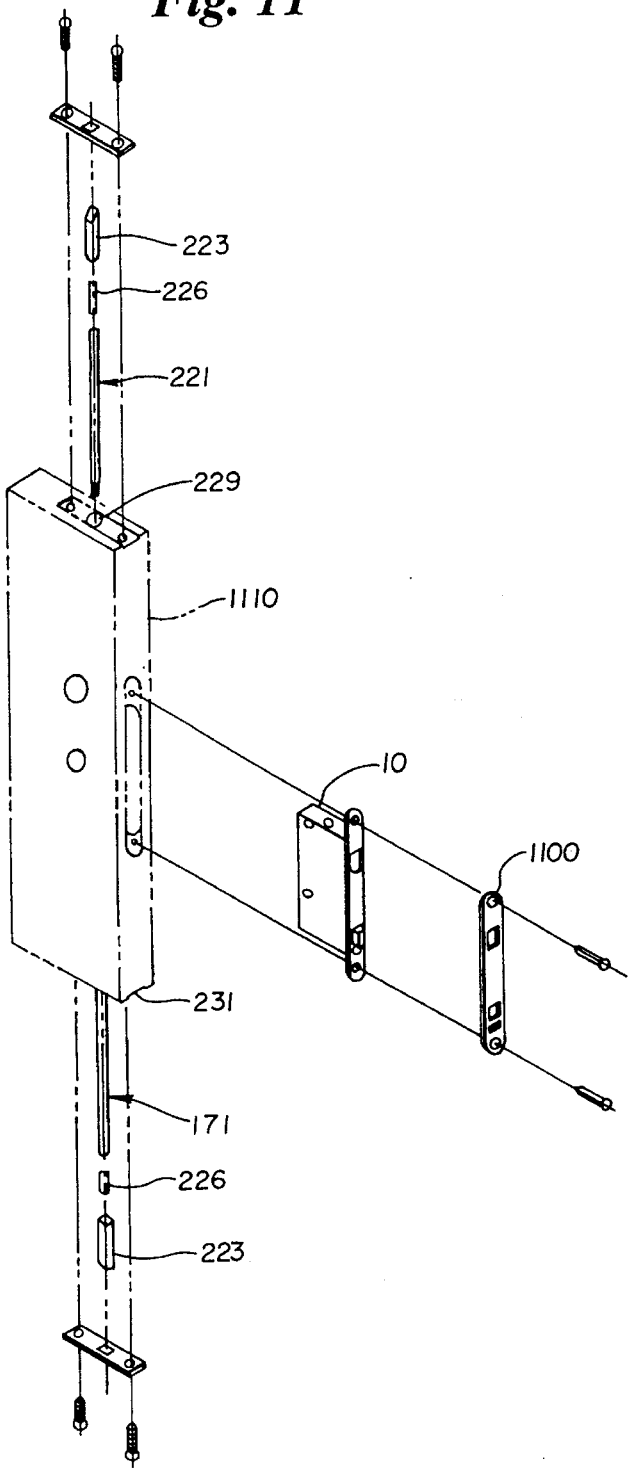
FIG. 11 is a not-to-scale assembly drawing showing installation of the active lock in an active door along with shoot bolt installation.

The shoot bolt rod assemblies (elements 226, 224, 227, 227) travel in a tunnel or channel within the door itself extending vertically from case 30 toward the upper 229 and lower 231 extremities of door 1110. The shoot bolts operate in a conventional manner well known to those of skill in the art and, when extended, engage the door frame (not shown) with their bolts 223. The relatively large travel permitted by the present invention permits the bolts 223 to extend up to about an inch into the door frame and aids weather proofing because this large degree of travel can be used to compress the door against conventional weather stripping by means of bevel 232 at the tip of bolt 223 for an improved weather seal. FIG. 11 illustrates the assembly of an active door 1110 comprising active lock 10, trim plate 1100, upper shoot bolt 221 and lower shoot bolt 171.

Shoot bolt rotor 250 is pivotally mounted to case 30 and pivots about axis 260. Upper shoot bolt activation link 230 is pivotally connected to shoot bolt rotor 250 at pivot point 270. Similarly lower shoot bolt activation link 240 is pivotally connected to shoot bolt rotor 250 at pivot point 280.

Figure 8:
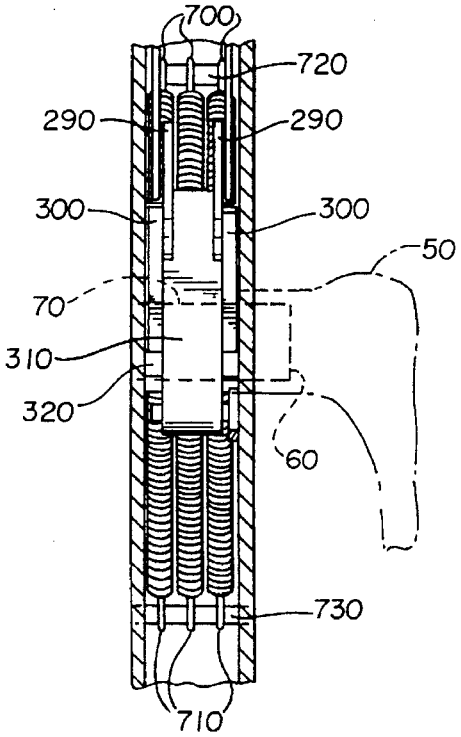
FIG. 8 is a side elevation view taken along line 8—8 of FIG. 2.

Pin rotor 80 is operatively coupled to shoot bolt rotor 250 by a linkage comprising a pair of pivotally connected link members 290, 300. Link member 300 is preferably a pair of oblong parallel plates connected with rivets at either end as shown in detail in FIG. 8. It encircles a portion 310 of pin rotor 80. Link member 290 is preferably a pair of bent or curved parallel plates connected with rivets at either end as shown in FIG. 8. Turning to FIG. 1 (left side) when pin rotor 80 is rotated counterclockwise, pin 320 protruding from pin rotor 80 engages link member 300. This action in turn forces link member 290 to push up against pivot point 330 where link member 290 is pivotally mounted to shoot bolt rotor 250. In turn shoot bolt rotor 250 rotates counterclockwise pulling shoot bolt activation links 230, 240 into case 30 disengaging shoot bolt receptacles 170 and 220.

Figure 7:
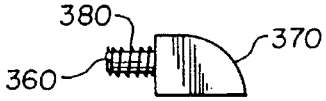
FIG. 7 is a top view of passage latch 370 taken along line 7—7 of FIG. 1.

Post 340 is attached to case 30 and has a hole 350 therethrough. Rod 360 passes through hole 350 and is attached to passage latch 370 by means of threads. Spring 380 is under compression and provides the bias of a spring under compression between door latch 370 and post 340. Rod 360 is attached to rod 400. Since rod 400 has a larger diameter than rod 360, lip 410 is formed and acts as a spring retainer. Spring 390 provides the bias of a spring under compression between lip 410 and post 340. Tracks 430 are provided in case 30 and pins 420 slide in tracks 430. As can be seen in FIG. 7, door latch (sometimes called passage latch) 370 has a curve on one side and a straight side on the other. In this sense active door lock 10 is "handed" meaning that if door lock 10 were mounted on the right side of a pair of double doors instead of the left, as shown, passage latch 370 would have to be rotated 180° about rod 360 so that it would operate correctly. Accordingly, the structure described above permits an installer to pull on door latch 370 and withdraw it from case 30 enough so that it clears mounting bracket 40 of case 30 and can be rotated 180° to set the "handedness" of the door latch. A trim plate 1100 (FIG. 11) may then be used to cover mounting bracket 40 and the rest of the mechanism. The trim plate may be thick enough so that passage latch 370 can no longer be pulled enough out of case 30 to rotate it. In this manner the "handedness" may be set at installation and cannot easily be tampered with after installation of the trim plates.

As described in more detail below, passage latch 370 can be retracted to permit opening of the active door by rotating the pin rotor 80 shown in FIG. 2 counterclockwise. The phantom drawing in FIG. 2 shows how this works. Lever 1130 is pivotally connected to case 30 at pivot point 1140. When pin 1120 interacts with 1130 upon counterclockwise rotation of pin rotor 80, lever 1130 moves from position 1150 (shown in outline in FIG. 2) to position 1160. In turn, portion 1170 of lever 1130 forces one of pins 420 (attached to rod 400) back (to the left in FIG. 2) retracting passage latch 370. When used with inactive lock 20, passage latch 370 is extendable into hole 1060 of case 730 of inactive lock 20 which acts as a passage latch receptacle. Passage latch 370 is so extendable when blocking slide 770 is in its "locked" position so that receptacle 771 of blocking slide 770 may receive passage latch 370.

Figure 4:
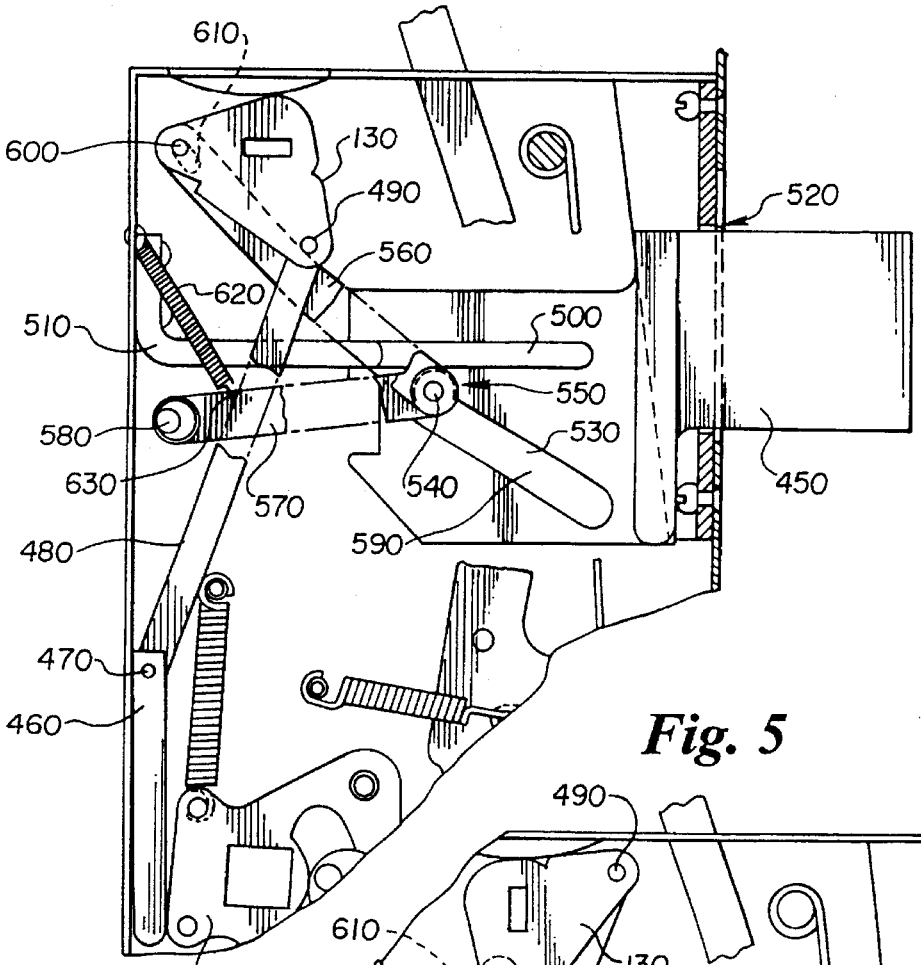
FIG. 4 is a partial front elevation drawing of an active multi-point door lock showing the jamb bolt engaged.
Figure 5:
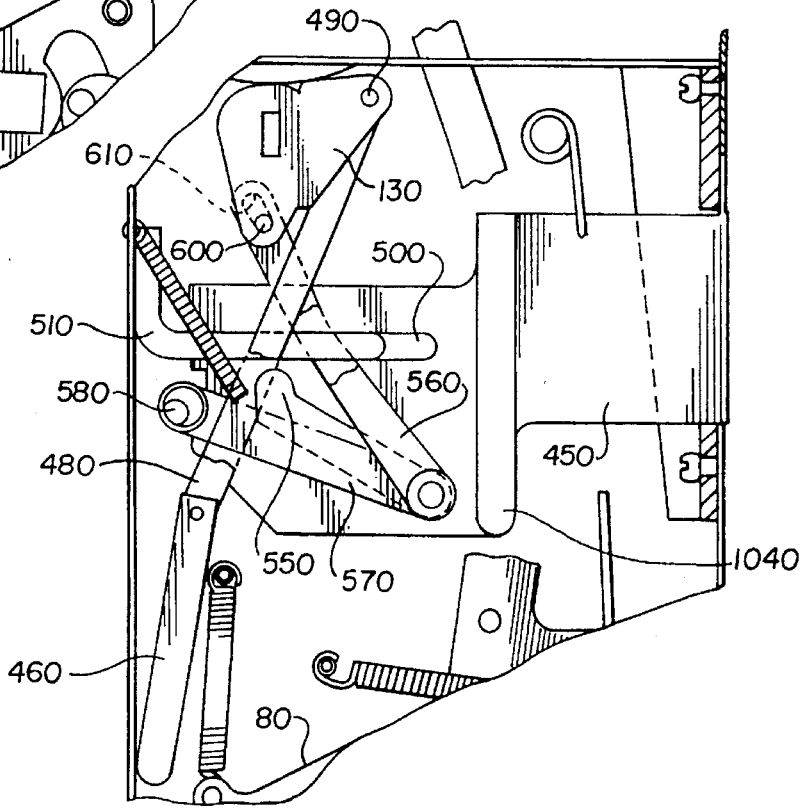
FIG. 5 is a partial front elevation drawing of an active multi-point door lock showing the jamb bolt disengaged.

Key rotor 130 is rotatable between a locked and an unlocked position. Curved spring 440 biases key rotor 130 to be stable and "stick" in one of the locked or unlocked position as shown. Turning now to FIGS. 4 and 5, FIG. 4 shows the effects of locking key rotor 130 by turning it clockwise. FIG. 5 shows the effects of unlocking key rotor 130 by turning it counterclockwise. In FIG. 4 key rotor 130 is fully clockwise. In this position, jamb bolt 450 is extended and pin rotor blocking member 460 is extended into position to interfere with the rotation of pin rotor 80. In FIG. 5 key rotor 130 is fully counterclockwise. In this position, jamb bolt 450 is retracted and pin rotor blocking member 460 is retracted so as not to interfere with the rotation of pin rotor 80.

Pin rotor blocking member 460 is pivotally connected at pivot point 470 to link 480. Link 480 is in turn pivotally connected at pivot point 490 to key rotor 130. Pin rotor blocking member 460 prevents rotation of pin rotor 80 when jamb bolt 450 is extended thus preventing retraction of shoot bolts 221, 171 when jamb bolt 450 is extended.

In addition to controlling the pin rotor blocking member 460, key rotor 130 also controls jamb bolt 450. Jamb bolt 450 includes a slot 500. Member 510 is attached to case 30 and fits into slot 500. Jamb bolt 450 also fits through hole 520 in case 30 through which it extends when in the engaged position (FIG. 4). Thus jamb bolt 450 travels right and left on the path defined by slot 500 and member 510.

Jamb bolt 450 also has a second slot 530 having a straight portion 540 and a locking portion 550. First double link 560 is a pair of parallel linking members. Second double link 570 is a pair of straight parallel linking members constructed in a similar fashion to links 290 and 300. Second double link 570 is pivotally connected to case 30 at pivot point 580. Second double link 570 is pivotally connected to first double link 560 at pivotal connection 590. Pivotal connection 590 is slidable in second slot 530. The remaining end of first double link 560 is pivotally and slidably connected to pin 600 of key rotor 130. First double link 560 preferably is slightly bent and includes slot 610 to permit lengthwise movement of first double link 560 about pin 600 as shown in FIGS. 4 and 5.

Second double link 570 is biased upward by spring 620 which has one end attached to case 30 and the other end attached to second double links 70 at point 630.

When key rotor 130 is rotated counterclockwise, pivotal connection 590 is forced down and to the right which in turn causes jamb bolt 450 to retract into frame member 30. When key rotor 130 is rotated clockwise, pivotal connection 590 is forced up and to the left which causes jamb bolt 450 to project from case 30. When key rotor 130 is fully clockwise, pivotal connection 590 is in locking portion 550 and held in place by spring 620. This configuration permits a ¼ turn (90° rotation) of key rotor 130 to cause jamb bolt 450 to travel nearly 1 inch.

Jamb bolt 450 is preferably fabricated of a laminate of 6 sheets of steel at the portion that extends from case 30. The interior portion which includes slots 500 and 530 is preferably fabricated of 2 laminated sheets of steel.

In order to generate audible and tactile feedback which can assure a user of the door latch that it has operated (i.e., latched), the following configuration is used. A pair of pins 640 are attached to the front (shown) and back (not shown) of shoot bolt rotor 250. A pair of flexible members 650 attached to a pin 660 in turn attached to case 30 travel around pins 640 and are then attached by springs 670 to pin 680 which is also attached to case 30. When shoot bolt rotor 250 is fully counterclockwise (disengaged) the bias imparted by flexible members 650 to shoot bolt rotor 250 tends to hold it in the disengaged position. When shoot bolt rotor 250 is rotated clockwise toward its engaged position, the bias imparted by flexible members 650 increases until the upper and lower shoot bolt activation links (230, 240) are aligned in a straight line ("centered"). And when the configuration is "over-center" and slightly clockwise of the centered position, the bias rapidly decreases and arms 690 of flexible members 650 rests about pin 640 preventing shoot bolt rotor 250 from moving further in the clockwise direction and makes an audible and tactile "click" when pin 640 and arm 690 come in contact. This contact configuration is depicted at FIG. 1. Curved spring 440 also provides tactile feedback by forcing key rotor 130 to adopt one of two stable positions.

Pin rotor 80 supports spindle 60 and door handle 50. Accordingly, significant bias may be required to return it to its neutral position after operation of the passage latch and/or shoot bolts. Pin rotor 80 is biased to neutral position by two sets of springs 700 and 710 having one of the ends of each spring affixed to the pin rotor as seen in FIG. 2. Springs 700 are attached to pin 720 which is in turn attached to case 30. Springs 710 are attached to pin 730 which is in turn attached to case 30. Each set of springs 700, 710 preferably consists of three springs in parallel.

The Inactive Lock

Figure 3:
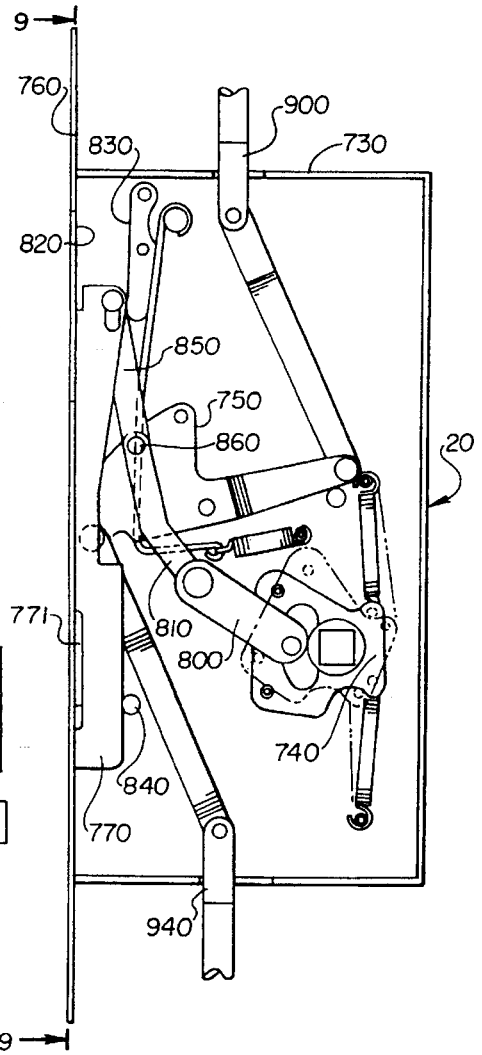
FIG. 3 is a front elevation drawing of an inactive multi-point door lock with the shoot bolts disengaged.
Figure 9:
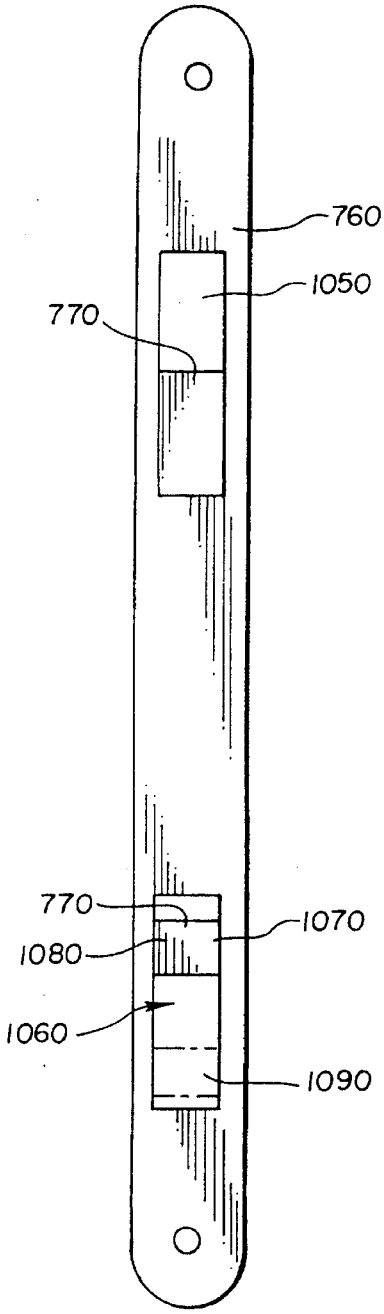
FIG. 9 is a side elevation view taken along line 9—9 of FIG. 3.

The inactive lock is depicted in FIG. 1 (right), FIG. 3 and FIG. 9. FIG. 1 shows the inactive lock 20 with shoot bolts extended but without jamb bolt 450 from active lock 10 inserted into it. FIG. 3 shows inactive lock 20 with shoot bolts retracted.

Turning now to FIG. 1 inactive door lock 20 comprises a case 730, a pin rotor 740, a shoot bolt rotor 750, a mounting flange 760 (part of case 730), and a blocking slide 770.

Case 730 and mounting flange 760 are constructed generally as in the active lock 10 described above. Pin rotor 740 is pivotally mounted to case 730 at pivot point 780 and is equipped with a spindle and handle as described above for the active lock 10. Shoot bolt rotor 750 is pivotally mounted to case 730 at pivot point 790. Pin rotor 740 is connected to shoot bolt rotor 750 with a linkage formed of link member 800 and link member 810. Link members 800, 810 are similar to link members 290, 300 in active lock 10 and operate in the same way.

Blocking slide 770 is adapted to be moveable vertically adjacent mounting flange 760. It is constrained to move in a track 815 defined by side 820, guide members 830 and guide post 840. Movement is imparted to blocking slide 770 through link member 850 which is pivotally mounted to shoot bolt rotor 750 at pivot point 860. Link member 810 is also pivotally mounted to pivot point 860. Link member 850 is also slidably and pivotally attached to blocking slide 770 at slot 870.

Upper shoot bolt activation link 880 is pivotally mounted to shoot bolt rotor 750 at pivot point 890. Upper shoot bolt receptacle 900 is pivotally mounted to upper shoot bolt activation link 880 at pivot point 910. Operation of the shoot bolts for inactive lock 20 is virtually identical to the operation described above for active lock 10. Lower shoot bolt activation link 920 is pivotally mounted to shoot bolt rotor 750 at pivot point 930. Lower shoot bolt receptacle 940 is pivotally mounted to lower shoot bolt activation link 920 at pivot point 950.

Pin rotor 740 is biased into position by springs 960 and 970 as described above for pin rotor 80.

Audible and tactile feedback associated with shoot bolt activation and release is provided by a single flexible member 980, attached to pin 990, positioned about pin 1000 on shoot bolt rotor 750 and attached with spring 1010 to pin 1020 as described above for flexible members 650.

General Operation

The operation of active lock 10 and inactive lock 20 is as follows:

Double Door Configuration

In a double door configuration, as shown in FIG. 1, the description of operation begins with the doors fully open. When the doors are open, all shoot bolts are in their open or inactivated or retracted positions. In FIG. 1 this corresponds to (1) active shoot bolt rotor 250 being fully counterclockwise; (2) inactive shoot bolt rotor 750 being fully clockwise; (3) jamb bolt 450 being retracted; (4) key rotor 130 being fully counterclockwise; and (5) pin rotors 80 and 740 having no torque applied through their handles and spindles.

Now, the inactive door (the door with inactive lock 20) may be shut. The pin rotor may be rotated with the handle to activate the shoot bolts to latch the door at the top and bottom. Next the active door (one with active lock 10) may be closed against the inactive door. Trigger 150 will be depressed pushing slide 160 back and freeing the shoot bolts to move from their retracted positions. The key rotor may not be rotated clockwise until the shoot bolts are extended because shoulder 1030 of shoot bolt rotor 250 blocks the extension of jamb bolt 450 by interfering with portion 1040 of jamb bolt 450. Thus in order to lock latch 10 with key rotor 130, the shoot bolt receptacles 170, 220 and shoot bolts 171, 221 must first be extended. Key rotor 130 still cannot be moved to the locked position without extending the shoot bolt receptacles 900, 940 and shoot bolts 901, 941 of inactive lock 20. This is because blocking slide 770 blocks hole 1050 ("jamb bolt receptacle") in mounting flange 760 (through which jamb bolt 450 must pass) when inactive lock 20 has its shoot bolts 901, 941 retracted. Blocking slide 770 also blocks passage latch 370 from entering inactive lock 20 by blocking position 1070 as described below. Activating (extending) shoot bolts 901, 941 involves rotation of shoot bolt rotor 750 which, through link member 850, causes blocking slide 770 to move from its blocking ("unlocked") position (as illustrated in FIG. 9 where hole 1050 is blocked to prevent entry of jamb bolt 450 and hole 1060 is blocked at position 1070 (blocking passage latch 370 from entry) by lower portion 1080 of blocking slide 770) to its non-blocking ("locked") position (where hole 1050 is free to receive jamb bolt 450 and lower portion, 1080 of blocking slide 770 no longer blocks position 1070 (where passage latch 370 would enter case 730) and instead blocks position 1090 so that trigger 150 is forced to retract when the active door is closed against the inactive door. This feature forces the inactive door to be shut and its shoot bolts extended first, before closing the active door. Closing the active door against the inactive door without first having extended the inactive door's shoot bolts results in inability to latch the active door with passage latch 370. Accordingly, the multi-point door latch system is "self-teaching" in that it forces the user to operate it in a predefined and mechanically constrained sequence which cannot be easily defeated. It can thus be seen that the entire closing and locking sequence of the inactive and active doors is fully defined by the mechanical constraints described above.

Opening the doors is done as follows. Key rotor 130 is positioned to unlock jamb bolt 450 and release pin rotor blocking member 460. The active lock handle can then be rotated counterclockwise. This disengages the active shoot bolts 171, 221 and causes pin 1120 to interact with lever 1130. Lever 1130 is pivotally mounted to case 30 at pivot point 1140. When pin 1120 interacts with lever 1130, lever 1130 moves from position 1150 (shown in outline in FIG. 2) to position 1160. In turn, portion 1170 of lever 1130 forces one of pins 420 back releasing door latch 370 from engagement with the inactive side (jamb or inactive latch).

Single Door Configuration

The essential difference between the operation of the double door configuration and the single door configuration is that the inactive door is absent from the single door configuration. In all other respects, the operation is substantially the same as that of the active latch portion of the double door configuration.

While embodiments and applications of this invention have been shown and described, it would be apparent to those skilled in the art that many more modifications are possible without departing from the inventive concepts herein. The invention, therefore, is not to be restricted except in the spirit of the appended claims.

What is claimed is:

1. A door latch mechanism for installation on the vertical free edge of an active door mounted in a door frame comprising:

a case having a surface for mounting essentially flush with the vertical free edge of the active door;

a shoot bolt rotor pivotally mounted to said case;

a pin rotor pivotally mounted to said case and offset from and operatively linked to said shoot bolt rotor, said pin rotor is biased toward a first position by a pair of springs each spring of said pair being affixed to the pin rotor; and an upper and a lower shoot bolt activation link operatively linked to said shoot bolt rotor, said upper and said lower shoot bolt activation links capable of movement between extended and retracted shoot bolt activation link positions, rotation of said pin rotor capable of controlling movement of said upper and said lower shoot bolt activation links between said extended and said retracted shoot bolt activation link positions.

2. A door latch mechanism for installation on the vertical free edge of an active door mounted in a door frame comprising:

a case having a surface for mounting essentially flush with the vertical free edge of the active door;

a shoot bolt rotor pivotally mounted to said case;

a pin rotor pivotally mounted to said case and offset from and operatively linked to said shoot bolt rotor;

an upper and a lower shoot bolt activation link operatively linked to said shoot bolt rotor, said upper and lower shoot bolt activation links capable of movement between extended and retracted shoot bolt activation link positions, rotation of said pin rotor capable of controlling movement of said upper and said lower shoot bolt activation links between said extended and said retracted shoot bolt activation link positions;

a passage link extendable through said surface and moveable between an extended and a retracted passage latch position, said passage latch is operatively linked to said pin rotor and rotation of said pin rotor is capable of controlling movement of said passage latch between said extended and retracted passage latch positions;

a key rotor pivotally mounted to said case;

a jamb bolt capable of movement between an extended jamb bolt position and a retracted jamb bolt position responsive to rotation of said key rotor;

first blocking means for blocking extension of said jamb bolt from said retracted jamb bolt position to said extended jamb bolt position when said upper and lower shoot bolt activation links are respectively in said retracted upper and lower shoot bolt activation link positions;

first biasing means for biasing said passage latch toward said extended passage latch position;

a trigger capable of movement between an extended trigger position and a retracted trigger position;

second biasing means for biasing said trigger toward said extended trigger position; and first blocking means for blocking extension of said upper and lower shoot bolt activation links, said first blocking means operatively linked to said trigger so that said blocking means operates to block extension of said upper and lower shoot bolt activation links when said trigger is in said extended trigger position.

* * * * *